US005276977A

United States Patent [19]

Cysewski

[11] Patent Number: 5,276,977

[45] Date of Patent: Jan. 11, 1994

[54] OCEAN-CHILL DRYING OF MICROALGAE AND MICROALGAL PRODUCTS

[75] Inventor: Gerald R. Cysewski, Kailua-Kona, Hi.

[73] Assignee: Cyanotech Corporation, Kailua-Kona, Hi.

[21] Appl. No.: 959,649

[22] Filed: Oct. 13, 1992

[51] Int. Cl.[5] ..... F26B 3/08

[52] U.S. Cl. ..... 34/10; 34/57 A; 159/4.02; 159/4.1

[58] Field of Search ..... 34/22, 57; 159/3, 4.02, 159/4.1; 110/245; 432/58

[56] References Cited

U.S. PATENT DOCUMENTS

| | | | |
|---|---|---|---|
| 3,100,693 | 8/1963 | Klein et al. | 159/4.02 |
| 4,171,243 | 10/1979 | Brooks et al. | 159/4.02 |
| 4,473,438 | 9/1984 | Loureiro | 159/4.02 |
| 5,223,088 | 6/1993 | Hansen | 159/4.1 |

*Primary Examiner*—Henry A. Bennet
*Assistant Examiner*—Denise L. Gromada
*Attorney, Agent, or Firm*—Donald A. Streck

[57] ABSTRACT

This is a method and apparatus for drying microalgae/-microalgal products which have been harvested and strained of excess water by a spray drying process. The method comprises, obtaining drying gas from a burner in which metered input air for combustion is mixed with fuel at or before a dryer gas heating burner and which does not require oxygen in the drying gas that is heated; using the drying gas to dry the microalgae/microalgal products in a spray dryer; separating dryed microalgae/microalgal products from moist drying gas in a cyclone; scrubbing and dehumidifying the moist drying gas; recycling the scrubbed and dehumidified drying gas to the dryer gas heating burner; and, venting a portion of the drying gas equivalent in volume to combustion gases generated in the burner. Scrubbing and dehumidifying is accomplished by spraying the moist drying gas with sea water at a temperature below 60° F. Also, the method includes recovering carbon dioxide from vented drying gas by directly contacting the vented drying gas with algal culture media.

29 Claims, 2 Drawing Sheets

OCEAN-CHILL DRYING OF MICROALGAE AND MICROALGAL PRODUCTS

BACKGROUND OF THE INVENTION

The present invention relates to methods and apparatus for the preparation of microalgae and microalgal products, and, more particularly, in a system for drying microalgae/microalgal products which have been harvested from an algal culture media-processing source and strained of excess water by a spray drying process it relates to an improvement by which oxidation of the microalgae/microalgal products is minimized and carbon dioxide is recovered and recycled to the algal culture media-processing source comprising, a burner for producing heated drying gas in which metered input air for combustion is mixed with fuel at or before a dryer gas heating burner and which does not require oxygen in drying gas which is heated; spray dryer means for using the heated drying gas from the burner to dry the microalgae/microalgal products; cyclone means for separating dryed microalgae/microalgal products from moist drying gas; means for scrubbing and dehumidifying the moist drying gas; means for recycling scrubbed and dehumidified drying gas to the dryer gas heating burner; means for venting a portion of the drying gas equivalent in volume to combustion gases created in the burner; a tank having an inlet receiving a flow of algal culture media from the algal culture media-processing source and an outlet returning the flow of algal culture media to the algal culture media-processing source; means for introducing the vented portion of the drying gas into the tank; and, means for mixing the portion of the drying gas through the algal culture media in the tank.

Microalgae are a potential source of food, fuel, chemicals, and pharmaceuticals. Microalgae are typically harvested from culture systems by screening, filtration, sedimentation, and centrifugation, or a combination thereof. Once harvested, microalgal cells contain from 85% to 90% water. The high water content is due to internal water in the cells that cannot be removed by mechanical means. As a result, drying of microalgae according to known prior art techniques is energy intensive and costly, accounting for as much as 30% of the production cost. In addition, many components of microalgae, such as beta-carotene and enzymes, are quickly oxidized if exposed to oxygen during the drying process.

Numerous methods have been used to dry microalgae and their products. Richmond et al. review drying methods applicable to microalgae in the *Handbook of Microalgal Mass Culture* as do Borowitzka et al. in *Micro-Algal Biotechnology*. These methods include sun drying on sand, sun drying on plastic sheets, drum drying in single and double drum dryers, and spray drying. Spray drying has the advantage of producing finely powdered microalgal products which are easily tabletted or blended with other components.

Masters reviews the present state-of-the-art of spray drying and also recommends methods applicable for microalgae in the fifth edition of the *Spray Drying Handbook*. For drying microalgae, Masters recommends an open-cycle spray dryer with a particular direct-fired air heater. As with drum drying, open-cycle spray drying with direct-fired air heaters exposes microalgae to elevated temperatures (140°-200° F.) and high oxygen concentrations (19-20%); and, offers no means for recovery of carbon dioxide produced in the dryer's burner.

In the *Spray Drying Handbook*, process layouts are discussed for spray drying. In particular, a semi-closed-cycle layout with a direct air heater is presented. The advantage of this type of spray dryer layout is that, with the proper type of burner, oxygen can be virtually eliminated from the recycled drying gas. Hence, oxygen-sensitive products are not oxidized during the drying process. The semi-closed-cycle layout and all other prior art closed-cycle layouts use a scrubber to remove product dust from the recycled drying gas and a separate condenser to dehumidify the recycled drying gas. There is also no mention or suggestion of recovery of carbon dioxide produced by combustion in the dryer burner.

Wherefore, it is the object of this invention to provide a process and associated apparatus for drying microalgae and microalgal products by employing a semi-closed-cycle layout wherein a low oxygen content is maintained in the recycled drying gas and wherein carbon dioxide is recovered from the recycled drying gas.

Other objects and benefits of the invention will become apparent from the detailed description which follows hereinafter when taken in conjunction with the drawing figures which accompany it.

SUMMARY OF THE INVENTION

The aforementioned objectives are achieved by a process for drying microalgae and their products which employs a spray dryer in a semi-closed layout and combines scrubbing and dehumidification of recycled drying gas. The drying process uses deep cold sea water as the scrubbing liquid and coolant for dehumidification. Carbon dioxide is also recovered for use as a source of carbon for the microalgae-producing culture.

More particularly, the aforementioned objectives have been achieved by apparatus for drying microalgae/microalgal products which have been harvested and strained of excess water by a spray drying process comprising, a burner for producing heated drying gas in which metered input air for combustion is mixed with fuel at or before a dryer gas heating burner and which does not require oxygen in drying gas which is heated; a spray dryer for using the heated drying gas from the burner to dry the microalgae/microalgal products; a cyclone for separating dryed microalgae/microalgal products from moist drying gas; means for scrubbing and dehumidifying the moist drying gas; means for recycling scrubbed and dehumidified drying gas to the dryer gas heating burner; and, means for venting a portion of the drying gas equivalent in volume to combustion gas generated in the burner.

In the preferred embodiment, the means for scrubbing and dehumidifying the moist drying gas comprises means for spraying the moist drying gas with water at a temperature below 60° F. This comprises means for obtaining sea water from a depth of at least 1,000 feet and means for spraying the moist drying gas with the sea water.

The preferred embodiment also includes means for recovering carbon dioxide from vented drying gas by absorption in alkaline liquid solutions. The preferred approach comprises means for directly contacting the vented drying gas with algal culture media. This can be implemented as a tank having algal culture media pumped therethrough between an inlet and an outlet thereof; means for introducing vented drying gas into the tank; and, means for agitating the algal culture media in the tank to mix the vented drying gas therethrough. It can also be implemented as an absorption tower having the algal culture media pumped therethrough between an inlet and an outlet thereof and means for passing the vented drying gas through the algal culture media in the tower.

DESCRIPTION OF THE DRAWING FIGURES

DESCRIPTION OF THE PREFERRED EMBODIMENT

The Ocean-Chill Drying process of the present invention to be described hereinafter allows microalgal cells or their products to be dried at low oxygen levels to protect oxygen-sensitive nutrients. Further, this unique drying process permits recovery of carbon dioxide from combustion in the dryer burner. As those skilled in the art are aware, carbon dioxide is the major nutrient required for microalgal growth. Thus, its recovery from the drying process for use in the growing process can result in lower production costs as will be described in greater detail hereinafter.

Figure 1:
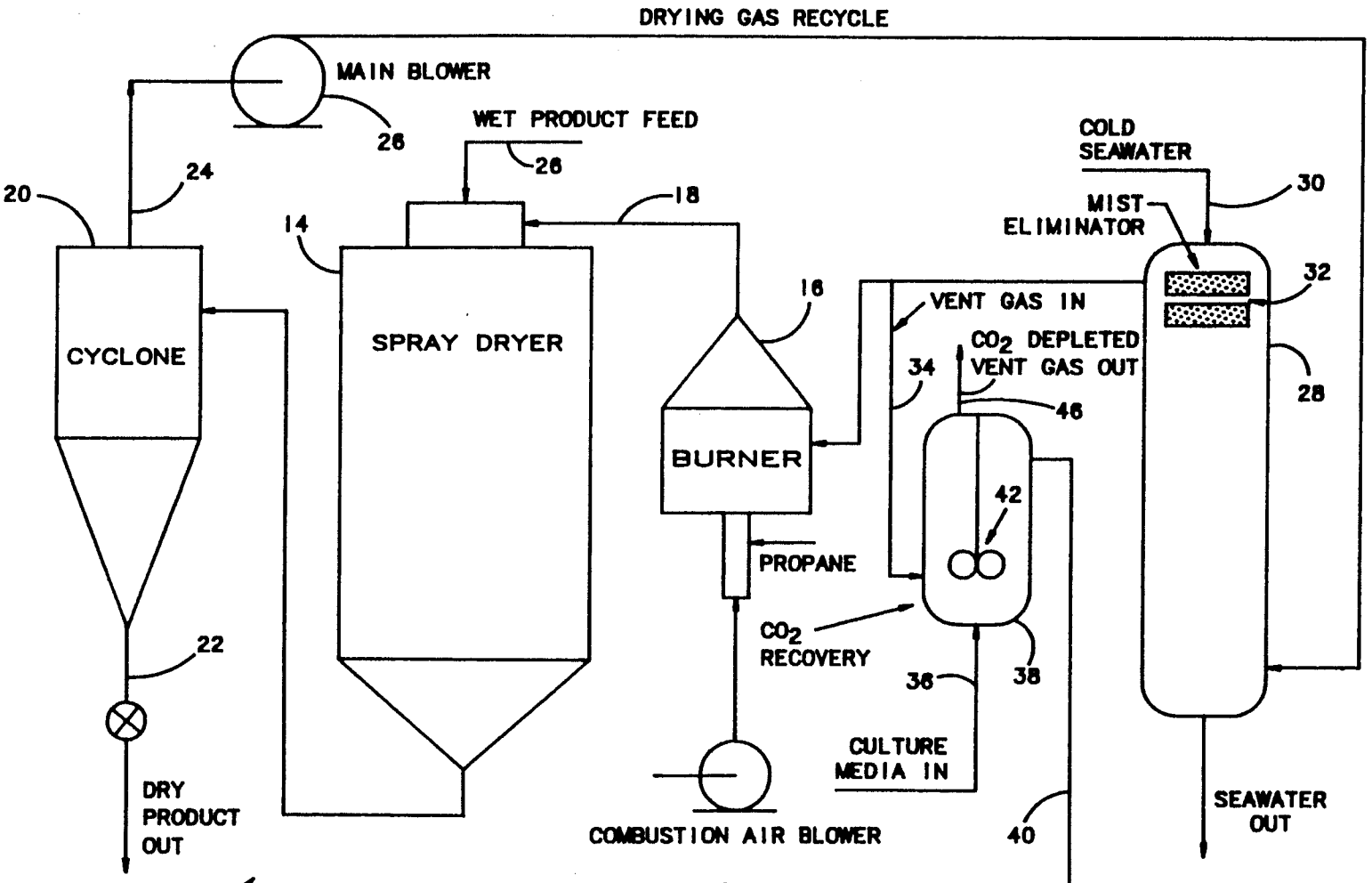
FIG. 1 is a functional block diagram of a drying system according to the present invention in an embodiment employing an agitated tank for the recovery of $CO_2$.

A process schematic or functional block diagram for the Ocean-Chill Drying system as implemented and is tested is shown in FIG. 1 where it is generally indicated as 10. Since the system 10 is a semi-closed-cycle system, one must begin some place; so, it is most convenient to start with the introduction of the wet product to be dried, which takes place at input line 26 leading into the spray dryer 14. Drying gas from the burner 16 enters the spray dryer 14 through input line 18. Dried powdered microalgal product, in humid drying gas, passes from the spray dryer 14 to a cyclone 20. The cyclone 20 removes 95% to 98% of the dried microalgal product which is drawn off at 22. Humid drying gas is withdrawn from cyclone 20 at 24 by main blower 26, which compresses the humid drying gas and feeds it to the dehumidification tower 28. In dehumidification tower 28, cold sea water at 45° F. to 55° F. from the line 30 is sprayed directly into the humid drying gas. The spray of cold sea water cools and condenses water from the drying gas, and also scrubs out the small amount of product dust not removed by the cyclone 20. The drying gas passes through a mist eliminator 32 (which removes small droplets of sea water), and then enters the burner 16 where it is heated to the proper inlet drying temperature before entering spray dryer 14 to complete the cycle. While not preferred, the dehumidification process could also take place in a heat exchanger condenser without direct contact between the sea water and the moist drying gas.

A Stoichiometric burner 16 is used, which requires no excess air for efficient combustion of propane or other fuels. Since combustion air and fuel are constantly fed to the burner 16 to heat recycled drying gas, a constant vent of gas equal to the volume of combustion gases generated in the burner 16 must be removed from the system as at 34. p At initial start-up of the system 10 from a stopped condition, the entire system 10 is filled with air containing 21% oxygen and 0.033% carbon dioxide. Once the spray dryer 14 is started, however, the continuous introduction of combustion gases at the burner 16 and the necessary venting at 34 rapidly changes the composition of the drying gas. Within a short time (5 to 30 minutes depending on the gas volume of the system) the composition of the drying gas becomes the same as that of the combustion gas generated in the burner 16, the most important points being that the oxygen concentration drops to between 2% and 0.25%, and the carbon dioxide level increases to between 8% and 10%. The low oxygen level greatly reduces oxidation of sensitive microalgal products while the high carbon dioxide level makes its recovery practical.

Figure 2:
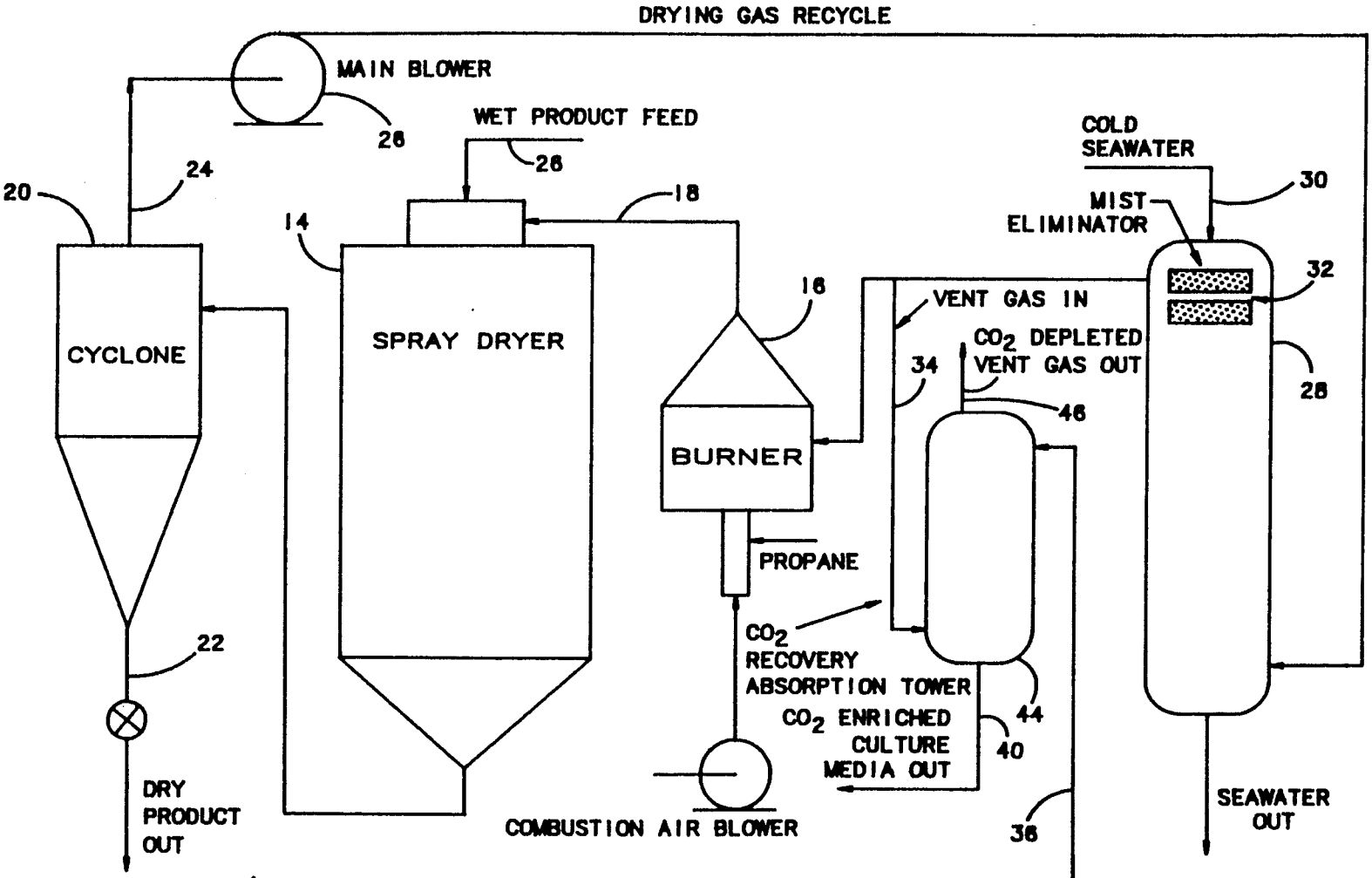
FIG. 2 is a functional block diagram of a drying system according to the present invention in an embodiment employing an absorption tower for the recovery of $CO_2$.

In the system 10 of FIG. 1, carbon dioxide is recovered by direct contact of vented gas with alkaline culture media entering from the main culture system (not shown) through inlet line 36 in an agitation tank 38. The carbon dioxide-enriched media is pumped back to the main culture system from the agitation tank 38 through the outlet line 40. The recovered carbon dioxide provides carbon for phototropic algal growth and also helps control the pH of the culture media. This approach for the recovery of carbon dioxide from the vented dryer gas has proved very efficient in actual tests, removing 90% to 97% of the carbon dioxide. Other carbon dioxide recovery techniques could be substituted in the system 10 within the scope and spirit of the present invention if desired, however, such as absorption into amines, the use of semi-permeable membranes, or the use of an absorption tower 44 as depicted in FIG. 2. With the absorption tower 44, the culture media enters at the top from inlet pipe 36 and exits at the bottom through outlet pipe 40. The vent gas containing the $CO_2$ enters at the bottom through line 34 and moves upward through the decending culture media to the vent 46 from which the $CO_2$ depleted vent gas exits. The technique and embodiment of FIG. 1 employing the agitated tank 38 is preferred, however.

It should be noted with specificity that the recovery of carbon dioxide from the dryer system using the approach of this invention is very cost effective and can supply the total carbon requirement for algal growth, thus eliminating the cost of purchasing carbon dioxide or other carbon sources.

It should be noted with particularity that the efficient recovery of carbon dioxide produced from combustion in the spray drying of microalgal products is unique to the present invention and has not been practical in prior art drying systems. Recovery of carbon dioxide from open-cycle spray dryers currently used for commercial drying of microalgae is not practical because of the low (0.06% to 0.1%) carbon dioxide concentration in the gas vented from the dryer. In contrast, gas vented form the Ocean-Chill Drying system 10 contains 8% to 10% carbon dioxide, making recovery very practical.

Recovery of carbon dioxide from the drying process is an important economic consideration and undoubtedly would have been done in prior art drying systems if such was possible and practical. The cost of carbon dioxide in remote or tropical areas, where microalgae culture is most practical, can be $0.20 per pound or higher. A $0.20 per pound cost for carbon dioxide equates to a $0.73 per pound cost for carbon. Microalgae is typically 50% carbon. Thus, the cost of supplying carbon dioxide for microalgal growth can be $0.37 per pound of microalgae produced or higher. If carbon dioxide gas is not available, other sources of carbon, such as sodium bicarbonate, must be purchased. Supplying carbon in the form of sodium bicarbonate results in a cost of $1.29 per pound of microalgae produced. By contrast, recovery of carbon dioxide from the drying process can completely supply the carbon requirement for microalgal growth, eliminating the need to purchase carbon dioxide, and thereby significantly reducing production costs The other unique aspect of this invention is the use of deep, cold sea water for dehumidification and scrubbing of the recycled drying gas. Commercial culture of microalgae requires high solar insulation, warm ambient temperatures, and low rainfall. Accordingly, geographical locations satisfying these basic requirements are in the tropical or subtropical regions of the world. In such areas, cold sea water or cold fresh water is generally not available; and cooling towers are not practical in such areas because of the high humidity. Also, it should be noted that cooling towers, in general, are not capable of producing sufficiently low temperatures for efficient dehumidification of recycled during gas.

Sea water temperature, however, declines the depth from the surface. Even in tropical areas, at a depth of 1,000 feet the sea water temperature is below 60° F. If sea water is pumped from a depth of 1,000 feet or deeper, it has a sufficiently low temperature to be used for efficient dehumidification of the recycled during gas. Using deep sea water as a cold fluid for dehumidification of the recycled drying gas is also very economical. A typical pumping cost to bring sea water to the surface from a depth of 2,000 feet is $0.08 per 1,000 gallons. To supply a similar amount of cooling as can be obtained from this 1,000 gallons of deep sea water through electric refrigeration would cost $3.40 (at a power cost of $0.12 per kwh).

The drying process of a commercial Spirulina microalgae production facility of the assignee of this invention located in Kona, Hi., was modified to form the system 10 of this invention as depicted in FIG. 1. The spray dryer used in the original system was a Niro Atomizer model S-12.5R. Prior to modification of the drying process, the spray dryer process was a direct-fired open-cycle system. Ambient air was drawn into the burner, heated to the selected inlet temperature and passed to the dryer chamber. Moist drying gas, containing dried product, moved from the drying chamber to a cyclone where product was removed. Moist air from the cyclone was pulled through the main blower and vented to the atmosphere. In this original processing system, Spirulina microalgae was exposed to 20% oxygen during the drying process, causing product degradation; and, no carbon dioxide recovery was possible because of its low (0.06%) concentration in the gas vented from the system.

To implement the present invention, the Niro Atomizer spray dryer was modified by replacing the standard burner with a Pyronics model 1001NM burner. The system was also replumbed so that gas from the main blower 26 went to the scrubbing/dehumidification tower 28, through the mist eliminator 32 and back to the burner 16. The scrubbing/dehumidification tower 32 is sixteen feet tall with a four foot diameter. A spray of deep sea water, pumped from a depth of 2,000 feet and having a temperature of 50° F., is sprayed into the tower at a rate of fifty gallons per minute through three main nozzles. Moist drying gas is contacted directly by the cold sea water to effect both dehumidification and scrubbing out of any product not removed by the cyclone 20. Carbon dioxide is recovered from gas vented from the drying process in the 1,000 gallon agitation tank 38 as described above. Agitation is supplied by a turbine impeller 42 connected to a five HP motor (not shown) and a continuous flow of 100 gallons per minute of culture media is passed through agitation tank 38.

During operation, harvested Spirulina "paste", having a dry solids content of 14%, is fed to the spray dryer 14. An inlet temperature of 400° F. is maintained by regulating the combustion air flow to the burner 16 which, in turn, regulates the propane flow. An outlet dryer gas temperature of 165° F. is maintained by adjusting the Spirulina feed rate to the spray dryer 14. The dryer process operation is very stable and can be operated continuously for over 24 hours, if required.

Before starting the drying process, air is present throughout the system. Thirty minutes after start-up, the oxygen concentration in the dryer will drop to below 1% while the carbon dioxide concentration increases to 8%. The low oxygen concentration in the dryer is very effective in protecting oxygen-sensitive nutrients, as shown in Table I. Table I compares the beta-carotene content of Spirulina dried by conventional spray drying and Spirulina dried by the Ocean-Chill Drying process of the present invention. Beta Carotene is easily oxidized if oxygen is present, especially at temperatures encountered in drying. As can be seen from the table, using a standard spray drying process (which uses air as the drying media), 55% of the beta-carotene was destroyed during drying. By contrast, only 11% of the beta-carotene in the feed Spirulina was oxidized with the Ocean-Chill Drying process.

TABLE I

Comparison of Standard Spray Drying and Ocean-Chill Drying

| | Standard Spray Drying | Ocean-Chill Drying |
|---|---|---|
| Inlet dryer temperature | 400° F. | 400° F. |
| Outlet dryer temperature | 165° F. | 165° F. |
| Feed beta-carotene content (dry basis) | 0.62% | 0.62% |
| Dried product beta-carotene content (dry basis) | 0.28% | 0.55% |
| % beta-carotene oxidized | 55% | 11% |

In addition to protecting oxygen-sensitive components, the Ocean-Chill Drying process allowed for recovery of carbon dioxide generated by combustion in the dryer burner. As mentioned above, the carbon dioxide level in the recycled drying gas increased to 8%. The vent gas is passed through an agitation tank for recovery of the carbon dioxide. After passing through the agitation tank, the level of carbon dioxide in the vent gas drops to less than 0.25% (0.25% was the lower detection limit of the carbon dioxide analysis used). This indicates that at least 96% of the carbon dioxide from the dryer is recovered in the algal culture media.

Wherefore having thus described the present invention, what is claimed is:

1. A method for drying microalgae/microalgal products which have been harvested and strained of excess water by a spray drying process comprising the steps of:

a) obtaining drying gas from a burner in which metered input air for combustion is mixed with fuel at or before a dryer gas heating burner and which does not require oxygen in the drying gas that is heated;

b) using the drying gas from step (a) to dry the microalgae/microalgal products in a spray dryer;

c) separating dryed microalgae/microalgal products from moist drying gas in a cyclone;

d) scrubbing and dehumidifying the moist drying gas;

e) recycling the scrubbed and dehumidified drying gas to the dryer gas heating burner; and, f) venting a portion of the drying gas equivalent in volume to combustion gases generated in said burner.

2. The method of claim 1 wherein said step (d) of scrubbing and dehumidifying the moist drying gas comprises the step of:

spraying the moist drying gas with water at a temperature below 60° F.

3. The method of claim 2 wherein said step of spraying the moist drying gas with water at a temperature below 60° F. comprises the steps of:

a) obtaining sea water from a depth of at least 1,000 feet; and, b) spraying the moist drying gas with the sea water.

4. The method of claim 1 wherein said step (d) of scrubbing and dehumidifying the moist drying gas comprises the step of:

dehumidifying the moist drying gas in a heat exchanger condenser without direct contact between water at a temperature below 60° F. and the moist drying gas.

5. The method of claim 4 wherein said step of dehumidifying the moist drying gas in a heat exchanger condenser without direct contact between water at a temperature below 60° F. and the moist drying gas comprises the steps of:

a) obtaining sea water from a depth of at least 1,000 feet; and, b) using the sea water in the heat exchanger condenser.

6. The method of claim 1 and additionally comprising the step of:

recovering carbon dioxide from vented drying gas by absorption in alkaline liquid solutions.

7. The method of claim 6 wherein said step of recovering carbon dioxide from vented drying gas by absorption in alkaline liquid solutions comprises the step of:

recovering carbon dioxide from vented drying gas by directly contacting the vented drying gas with algal culture media.

8. The method of claim 7 wherein said step of recovering carbon dioxide from vented drying gas by directly contacting the vented drying gas with algal culture media comprises the steps of:

a) pumping algal culture media through a tank;

b) introducing vented drying gas into the tank; and, c) agitating the algal culture media in the tank to mix the vented drying gas passes therethrough.

9. The method of claim 7 wherein said step of recovering carbon dioxide from vented drying gas by directly contacting the vented drying gas with algal culture media comprises the steps of:

a) pumping algal culture media through an absorption tower; and, b) passing vented drying gas through the absorption tower and the algal culture media therein.

10. A method for drying microalgae/microalgal products which have been harvested and strained of excess water by a spray drying process in which oxidation of the microalgae/microalgal products is minimized and carbon dioxide is recovered comprising the steps of:

a) obtaining drying gas from a burner in which metered input air for combustion is mixed with fuel at or before a dryer gas heating burner and which does not require oxygen in the drying gas that is heated;

b) using the drying gas from step (a) to dry the microalgae/microalgal products in a spray dryer;

c) separating dryed microalgae/microalgal products from moist drying gas in a cyclone;

d) scrubbing and dehumidifying the moist drying gas;

e) recycling the scrubbed and dehumidified drying gas to the dryer gas heating burner;

f) venting a portion of the drying gas equivalent in volume to combustion gas generated in the burner; and, g) recovering carbon dioxide from vented drying gas by absorption in alkaline liquid solutions.

11. The method of claim 10 wherein said step (g) of recovering carbon dioxide from vented drying gas by absorption in alkaline liquid solutions comprises the step of:

recovering carbon dioxide from vented drying gas by directly contacting the vented drying gas with algal culture media.

12. The method of claim 11 wherein said step of recovering carbon dioxide from vented drying gas by directly contacting the vented drying gas with algal culture media comprises the steps of:

a) pumping algal culture media through a tank;

b) introducing vented drying gas into the tank; and, c) agitating the algal culture media in the tank to mix the vented drying gas passes therethrough.

13. The method of claim 11 wherein said step of recovering carbon dioxide from vented drying gas by directly contacting the vented drying gas with algal culture media comprises the steps of:

a) pumping algal culture media through an absorption tower; and, b) passing vented drying gas through the absorption tower and the algal culture media therein.

14. The method of claim 10 wherein said step (d) of scrubbing and dehumidifying the moist drying gas comprises the step of:

spraying the moist drying gas with water at a temperature below 60° F.

15. The method of claim 14 wherein said step of spraying the moist drying gas with water at a temperature below 60° F. comprises the steps of:

a) obtaining sea water from a depth of at least 1,000 feet; and, b) spraying the moist drying gas with the sea water.

16. Apparatus for drying microalgae/microalgal products which have been harvested and strained of excess water by a spray drying process comprising:

a) burner means for producing heated drying gas in which metered input air for combustion is mixed with fuel at or before a dryer gas heating burner and which does not require oxygen in drying gas which is heated;

b) spray dryer means for using said heated drying gas from said burner means to dry the microalgae/microalgal products;

c) cyclone means for separating dryed microalgae/microalgal products from moist drying gas;

d) means for scrubbing and dehumidifying said moist drying gas;

e) means for recycling scrubbed and dehumidified drying gas to said dryer gas heating burner; and, f) means for venting a portion of said drying gas equivalent in volume to combustion gases generated in said burner means.

17. The apparatus of claim 16 wherein said means for scrubbing and dehumidifying said moist drying gas comprises:

means for spraying said moist drying gas with water at a temperature below 60° F.

18. The apparatus of claim 17 wherein said means for spraying said moist drying gas with water at a temperature below 60° F. comprises:

a) means for obtaining sea water from a depth of at least 1,000 feet; and, b) means for spraying the moist drying gas with said sea water.

19. The apparatus of claim 16 and additionally comprising:

means for recovering carbon dioxide from vented drying gas by absorption in alkaline liquid solutions.

20. The apparatus of claim 19 wherein said means for recovering carbon dioxide from vented drying gas by absorption in alkaline liquid solutions comprises:

means for directly contacting said vented drying gas with algal culture media.

21. The apparatus of claim 19 wherein said means for recovering carbon dioxide from vented drying gas by absorption in alkaline liquid solutions comprises:

a) a tank having algal culture media pumped therethrough between an inlet and an outlet thereof;

b) means for introducing vented drying gas into said tank; and, c) means for agitating said algal culture media in said tank to mix said vented drying gas therethrough.

22. The apparatus of claim 19 wherein said means for recovering carbon dioxide from vented drying gas by absorption in alkaline liquid solutions comprises:

a) an absorption tower having algal culture media pumped therethrough between an inlet at a top end thereof and an outlet at a bottom end thereof;

b) inlet means for introducing vented drying gas into said absorption tower at said bottom end thereof; and, c) outlet means for venting $CO_2$-depleted vented drying gas from said absorption tower tank at said top end thereof.

23. Apparatus for drying microalgae/microalgal products which have been harvested and strained of excess water by a spray drying process in which oxidation of the microalgae/microalgal products is minimized and carbon dioxide is recovered comprising:

a) burner means for producing heated drying gas in which metered input air for combustion is mixed with fuel at or before a dryer gas heating burner and which does not require oxygen in drying gas which is heated;

b) spray dryer means for using said heated drying gas from said burner means to dry the microalgae/microalgal products;

c) cyclone means for separating dryed microalgae/-microalgal products from moist drying gas;

d) means for scrubbing and dehumidifying said moist drying gas;

e) means for recycling scrubbed and dehumidified drying gas to said dryer gas heating burner;

f) means for venting a portion of said drying gas equivalent in volume to combustion gases generated by said burner means; and, g) means for recovering carbon dioxide from vented drying gas by absorption in alkaline liquid solutions.

24. The apparatus of claim 23 wherein said means for recovering carbon dioxide from vented drying gas by absorption in alkaline liquid solutions comprises:

means for directly contacting said vented drying gas with algal culture media.

25. The apparatus of claim 23 wherein said means for recovering carbon dioxide from vented drying gas by absorption in alkaline liquid solutions comprises:

a) a tank having algal culture media pumped therethrough between an inlet and an outlet thereof;

b) means for introducing vented drying gas into said tank; and, c) means for agitating said algal culture media in said tank to mix said vented drying gas therethrough.

26. The apparatus of claim 23 wherein said means for recovering carbon dioxide from vented drying gas by absorption in alkaline liquid solutions comprises:

a) an absorption tower having algal culture media pumped therethrough between an inlet at a top end thereof and an outlet at a bottom end thereof;

b) inlet means for introducing vented drying gas into said absorption tower at said bottom end thereof; and, c) outlet means for venting $CO_2$-depleted vented drying gas from said absorption tower tank at said top end thereof.

27. The apparatus of claim 23 wherein said means for scrubbing and dehumidifying said moist drying gas comprises:

a) means for obtaining sea water from a depth of at least 1,000 feet; and, b) means for spraying the moist drying gas with said sea water.

28. In apparatus for drying microalgae/microalgal products which have been harvested from a algal culture media-processing source and strained of excess water by a spray drying process an improvement by which oxidation of the microalgae/microalgal products is minimized and carbon dioxide is recovered and recycled to the algal culture media-processing source comprising:

a) burner means for producing heated drying gas in which metered input air for combustion is mixed with fuel at or before a dryer gas heating burner and which does not require oxygen in drying gas which is heated;

b) spray dryer means for using said heated drying gas from said burner means to dry the microalgae/microalgal products;

c) cyclone means for separating dryed microalgae/-microalgal products from moist drying gas;

d) means for scrubbing and dehumidifying said moist drying gas;

e) means for recycling scrubbed and dehumidified drying gas to said dryer gas heating burner;

f) means for venting a portion of said drying gas equivalent in volume to combustion gases generated in said burner means;

g) a tank having an inlet receiving a flow of algal culture media from the algal culture media-processing source and an outlet returning said flow of algal culture media to the algal culture media-processing source;

h) means for introducing said portion of said drying gas into said tank; and, i) means for mixing said portion of said drying gas through said algal culture media in said tank.

29. In apparatus for drying microalgae/microalgal products which have been harvested from a algal culture media-processing source and strained of excess water by a spray drying process an improvement by which oxidation of the microalgae/microalgal products is minimized and carbon dioxide is recovered and recycled to the algal culture media-processing source comprising:

a) burner means for producing heated drying gas in which metered input air for combustion is mixed with fuel at or before a dryer gas heating burner and which does not require oxygen in drying gas which is heated;

b) spray dryer means for using said heated drying gas from said burner means to dry the microalgae/microalgal products;

c) cyclone means for separating dryed microalgae/microalgal products from moist drying gas;

d) means for scrubbing and dehumidifying said moist drying gas;

e) means for recycling scrubbed and dehumidified drying gas to said dryer gas heating burner;

f) means for venting a portion of said drying gas equivalent in volume to combustion gases generated in said burner means;

g) an absorption tower having algal culture media pumped therethrough between an inlet at a top end thereof and an outlet at a bottom end thereof;

h) inlet means for introducing vented drying gas into said absorption tower at said bottom end thereof; and, i) outlet means for venting $CO_2$-depleted vented drying gas from said absorption tower tank at said top end thereof.

* * * * *